US010220295B2

(12) United States Patent
Semerano

(10) Patent No.: US 10,220,295 B2
(45) Date of Patent: Mar. 5, 2019

(54) SYSTEM, METHOD AND APPARATUS FOR PREPARING AND MAINTAINING A PITCHING MOUND

(71) Applicant: Robert A. Semerano, Port Jervis, NY (US)

(72) Inventor: Robert A. Semerano, Port Jervis, NY (US)

( * ) Notice: Subject to any disclaimer, the term of this patent is extended or adjusted under 35 U.S.C. 154(b) by 0 days.

(21) Appl. No.: 15/095,879

(22) Filed: Apr. 11, 2016

(65) Prior Publication Data

US 2016/0296822 A1 Oct. 13, 2016

Related U.S. Application Data

(60) Provisional application No. 62/145,892, filed on Apr. 10, 2015.

(51) Int. Cl.

| | |
|---|---|
| ***A63B 71/00*** | (2006.01) |
| ***A63C 19/04*** | (2006.01) |
| ***A63B 69/00*** | (2006.01) |

(52) U.S. Cl.

CPC ..... *A63C 19/04* (2013.01); *A63B 69/0002* (2013.01); *A63B 2069/0006* (2013.01); *A63B 2210/50* (2013.01)

(58) Field of Classification Search

CPC ..... A63C 19/04; A63B 69/0002; A63B 2069/0006; A63B 2210/50

USPC ..... 473/497, 499–500, 415, 451, 468

See application file for complete search history.

(56) References Cited

U.S. PATENT DOCUMENTS

| | | | | | |
|---|---|---|---|---|---|
| 3,479,028 | A | * | 11/1969 | Goeders | A63B 69/0002 473/497 |
| 4,561,653 | A | * | 12/1985 | Wright | A63B 71/00 473/497 |
| 4,666,155 | A | * | 5/1987 | Stille | A63B 69/0002 473/497 |
| 4,758,002 | A | * | 7/1988 | Murphy | A63B 69/0002 473/468 |
| 4,781,385 | A | * | 11/1988 | Harley | A63B 59/00 473/468 |
| 4,798,389 | A | * | 1/1989 | Long | A63C 19/00 473/468 |
| 4,973,061 | A | * | 11/1990 | Catherall | A63B 69/0002 473/468 |
| 5,058,889 | A | * | 10/1991 | Burton | A63B 69/0002 473/452 |
| 5,467,977 | A | * | 11/1995 | Beck | A63B 69/0013 473/497 |
| 5,707,305 | A | * | 1/1998 | Goeders | A63B 69/0002 473/497 |

(Continued)

*Primary Examiner* — Mitra Aryanpour

(74) *Attorney, Agent, or Firm* — Fay Kaplun & Marcin, LLP

(57) ABSTRACT

A pitching mound form having a flange structure and a wall structure coupled to the flange structure such that the wall structure extends substantially perpendicular from a plane of the flange, wherein the flange structure and the wall structure form a substantially rectangular cavity, wherein the wall structure has a first height at a first end of the rectangular cavity and a second height at a second end of the rectangular cavity, and wherein the wall structure has the first height for a predetermined length from the first end and then tapers at a predetermined slope to the second end.

12 Claims, 12 Drawing Sheets

(56) References Cited

U.S. PATENT DOCUMENTS

| | | | | |
|---|---|---|---|---|
| 7,131,918 | B1 * | 11/2006 | Prince | A63B 67/002 473/468 |
| 7,621,831 | B2 * | 11/2009 | Roberts | A63B 69/0002 473/497 |
| 7,658,688 | B2 * | 2/2010 | Weidner | A63B 67/002 473/451 |
| 8,944,941 | B2 * | 2/2015 | Carlson | A63B 69/0013 473/497 |
| 2003/0176243 | A1 * | 9/2003 | Joseph | A63B 71/022 473/415 |
| 2007/0111828 | A1 * | 5/2007 | Goeders | A63B 69/0002 473/497 |
| 2013/0196797 | A1 * | 8/2013 | Lee | A63B 69/0013 473/497 |
| 2016/0296822 | A1 * | 10/2016 | Semerano | A63B 69/0002 473/497 |

* cited by examiner

SYSTEM, METHOD AND APPARATUS FOR PREPARING AND MAINTAINING A PITCHING MOUND

PRIORITY CLAIM/INCORPORATION BY REFERENCE

This application claims priority to U.S. Provisional Application 62/145,892 entitled "Pitching Mound Apparatus," filed on Apr. 10, 2015, the entirety of which is incorporated herein by reference.

BACKGROUND

There are thousands of baseball fields throughout the United States and the world. Each of these baseball fields has a pitching mound that is one of the most important aspects of a baseball field. There are specific rules that apply to different pitching mounds. The rules may be promulgated by various organizations in their rules for playing baseball, such as Major league Baseball ("MLB"), National Collegiate Athletic Association ("NCAA") baseball, Little League baseball, Babe Ruth baseball, Cal Ripken League baseball, Legion baseball, various high school and youth league baseball organizations, etc. The rules may include such things as the distance from the pitching mound rubber to home plate, the height of the mound, the slope of the mound, etc.

In certain organizations such as MLB and NCAA, there may be professional grounds crews that take care of the fields and the mounds to assure that the fields meet the exacting rules of these organizations. However, most of the fields are municipal, school or league owned and do not have professional grounds crews that maintain the fields. Rather, there are volunteers that give up their personal time to make sure that the fields are ready for play, e.g., dads and moms of players, high school coaches, etc. While these volunteers are to be commended for their dedication, they are not always aware of the rules or do not have the equipment that makes it possible for them to maintain the field, especially the pitching mounds to the exact specifications required by the rules.

This is especially true for multi-purpose fields such as fields that host baseball games that are played at different dimensions, e.g., a 46/60 game and a 50/70 game. These dimensions refer to the distance from the pitching mound to home plate/the distance between each base. Thus, 46/60 refers to a field having a dimension of 46 feet from the pitching mound to home plate and a dimension of 60 feet between consecutive bases (e.g., between home plate and first base, between first base and second base, etc.). Therefore, throughout this description, this nomenclature of XX/YY will be used to describe exemplary baseball field dimensions.

There are many reasons why it is important for the specifications of the pitching mound to be in conformance with the rules including such things as the integrity of the game, to provide a consistent playing field, etc. However, one of the most important reasons is player safety. The specifications of the pitching mound are provided to give the pitcher the same feel and motion that should be repeatable at any field at which the pitcher pitches. When there are inconsistencies such as non-uniform heights, slopes or landing surfaces, there is a higher likelihood of injury to the pitcher, including al in injuries that may be career threatening. As described above, when there are non-professionals taking care of fields, these non-professionals may not have the time or equipment necessary to assure that the pitching mound is standardized to the correct specifications.

SUMMARY

A pitching mound form having a flange structure and a wall structure coupled to the flange structure such that the wall structure extends substantially perpendicular from a plane of the flange, wherein the flange structure and the wall structure form a substantially rectangular cavity, wherein the wall structure has a first height at a first end of the rectangular cavity and a second height at a second end of the rectangular cavity, and wherein the wall structure has the first height for a predetermined length from the first end and then tapers at a predetermined slope to the second end.

A pitching mound form having at least two side rails that are arranged substantially parallel in relation to each other, each of the side rails having a top surface at first height from a first location to a second location, the top surface of each of the side rails tapering at a predetermined slope from the second location to a third location, a plateau portion having a substantially flat top surface and being coupled to each of the side rails between the first location and the second location such that the top surface of the plateau portion is located at the first height and a pitching rubber arranged between the first location and the second location.

A pitching mound form having a first pitching rubber located at a first height, wherein the first height corresponds to a top surface of the pitching mound form, wherein the pitching mound form is configured to be installed on a baseball field such that the first pitching rubber is located at a first distance from home plate of the baseball field; and a second pitching rubber located at a second height, wherein the second height is lower than the first height, wherein the second pitching rubber is located at a second distance from home plate of the baseball field when the pitching mound form is installed on the baseball field, wherein the second distance is less than the first distance.

DETAILED DESCRIPTION

Figure 1:
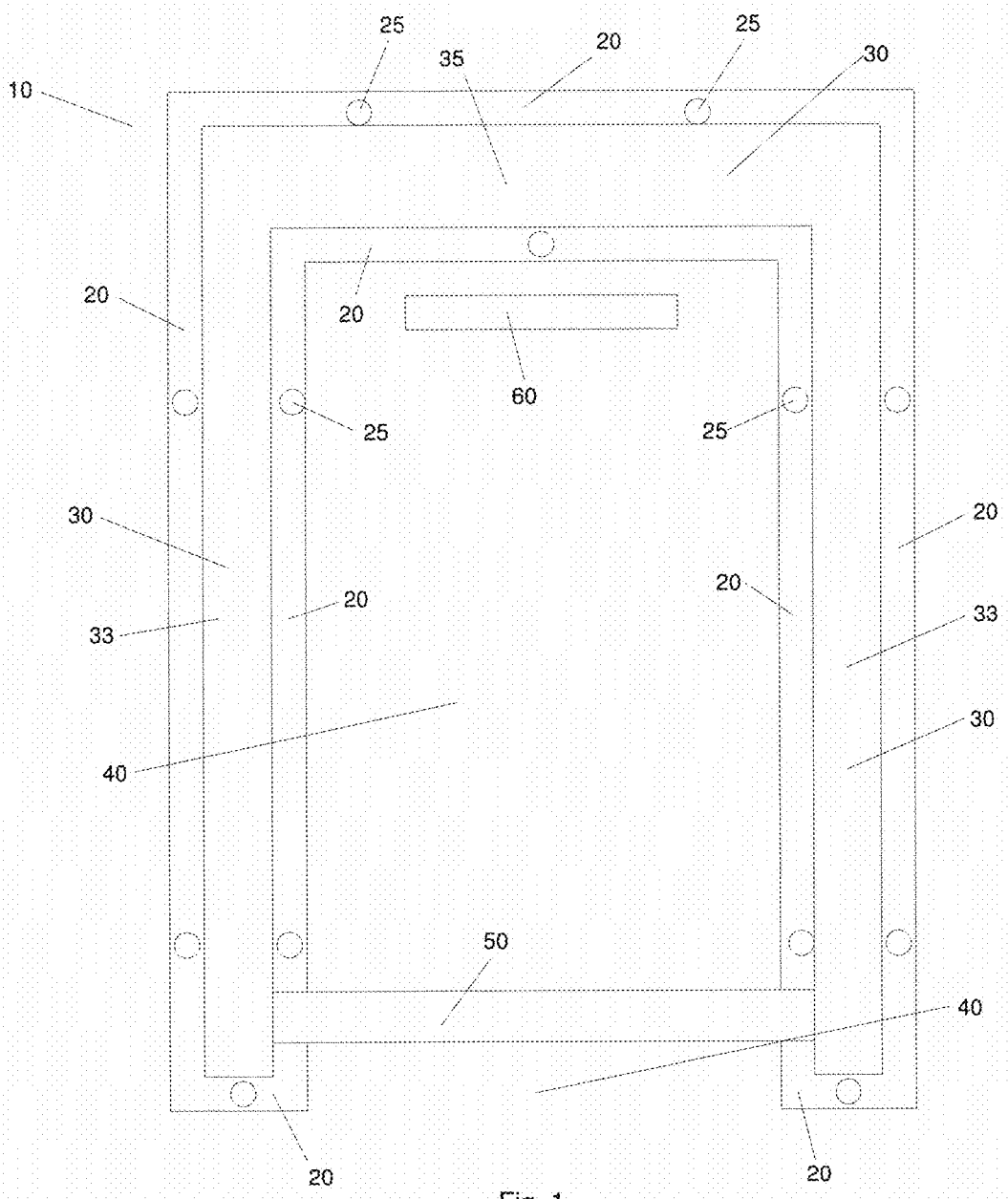
FIG. 1 shows a top view of a first exemplary pitching mound form.

The exemplary embodiments may be further understood with reference to the following description and the appended drawings, wherein like elements are referred to with the same reference numerals. The exemplary embodiments describe system, method and apparatus for preparing and maintaining a pitching mound. Specifically, the exemplary embodiments provide a pitching mound form that has proper dimensions (e.g., height, slope, etc.) that may be inserted into a pitching mound so that non-professionals may prepare and maintain a proper pitching mound on any field.

It should be noted that in the exemplary embodiments, various dimensions will be described for the pitching mound forms and the pitching mounds. Three (3) specific types of fields and corresponding pitching mounds will be described, a 46/60 field, a 50/70 field and a 60/90 field. These three specific types of fields cover a majority of the fields that are currently in use today. However, it should be understood that the dimensions are only exemplary and other dimensions may be used as required to meet the rules of any particular organization or other field types.

FIG. 1 shows a top view of a first exemplary pitching mound form 10. In this exemplary embodiment, no specific field or pitching mound dimensions will be provided as the exemplary embodiment will provide the general characteristics of the pitching mound form 10. Thus, the first exemplary pitching mound form 10 may represent any dimensions for the exemplary pitching mound form depending on the specific application. Additional exemplary embodiments will be described below that will provide specific exemplary pitching mound dimensions for various types of fields.

The pitching mound form 10 includes a perimeter flange 20 that extends around the entire perimeter of the pitching mound form 20. The perimeter flange 20 is located at the bottom of the pitching mound form 10 that will be in contact with the ground on which the pitching mound form 10 is placed. The perimeter flange 20 may be formed from one structural component or may be more than one structural component. In one exemplary embodiment, the perimeter flange is a single structural component that is approximately ½" thick and may be formed of any type of structural material, e.g., steel, composite material, fiberglass, aluminum, wood, etc. The perimeter flange 20 may include a series of eyelets 25 that may be used to anchor the pitching mound form 10 to the ground as will be described in greater detail below. The example shows twelve (12) eyelets, but other numbers of eyelets may be used.

It should be noted that the perimeter flange 20 does not need to extend both inside and outside the pitching mound form 10 as shown in FIG. 1. That is, the perimeter flange 20 may only extend inside the pitching mound form 10 or may only extend outside the pitching mound form 10. It should also be noted that the functionality of the perimeter flange 20 is to allow the pitching mound form 10 to be secured to the ground of the playing field. Thus, those skilled in the art will understand that other structures may be substituted for the perimeter flange 20 to perform this functionality. For example, a fastening structure such as hollow cylinders configured to receive spikes or nails may be directly coupled to the side rails (described in greater detail below) for fastening the pitching mound form 10 to the ground of the playing field.

The pitching mound form 10 also includes a wall structure 30 that is generally perpendicular to the plane of the perimeter flange 20. The wall structure 30 may be formed of any material in the same manner as the perimeter flange 20. The wall structure 30 may include two components, side rails 33 and plateau portion 35. As will be described in greater detail below, the side rails 33 have a slope, while the plateau portion 35 is flat. The top of the plateau portion 35 and the side rails 33 are designed to follow the contour of the pitching mound and may generally be exposed when placed into the pitching mound as will be described in greater detail below. Since the top of the plateau portion 35 and the side rails 33 are exposed, e.g., the pitcher may step on these exposed portions when in use, the tops may be covered with a synthetic material that will prevent the pitcher from slipping on the exposed portions.

The combination of the perimeter flange 20 and the wall structure 30 creates a cavity 40 that will be filled with pitching mound clay or clay bricks when the pitching mound form 10 is placed in its proper position in the pitching mound. The pitching mound form 10 also includes a structural member 50 that is attached to either the side rails 33 or the perimeter flange 20 to provide structural support for the pitching mound form 10. In this exemplary embodiment, the structural member 50 is a single cross brace. Those skilled in the art will understand that the structural member 50 may be formed in any number of manners, including multiple cross braces, diagonal braces, etc. In addition, the location of the structural member 50 as shown in FIG. 1 is only exemplary as the structural member 50 may be located anywhere within the pitching mound form 10 that serves the function of providing structural support. The structural member 50 will have a top surface that is lower than the wall structure 30 such that the structural member will not be exposed when the cavity 40 is filled with the pitching mound clay or clay bricks.

The pitching mound form 10 also includes a rubber 60. The rubber 60 may be permanently or removeably coupled to the pitching mound form 10. Those skilled in the art will understand that the rubber 60 is a required portion of a pitching mound per the rules of baseball. The pitcher must begin the pitching motion while in contact with the rubber 60. In this exemplary embodiment, the rubber 60 is in the cavity area 40 meaning that the rubber 60 will attach to the wall structure 30 or the perimeter flange 20, but be surrounded by the pitching mound clay that will fill the cavity area 40. In another exemplary embodiment, the rubber 60 may be within or at the edge of the plateau portion 35. This exemplary embodiment will be described in greater detail below.

Figure 2:
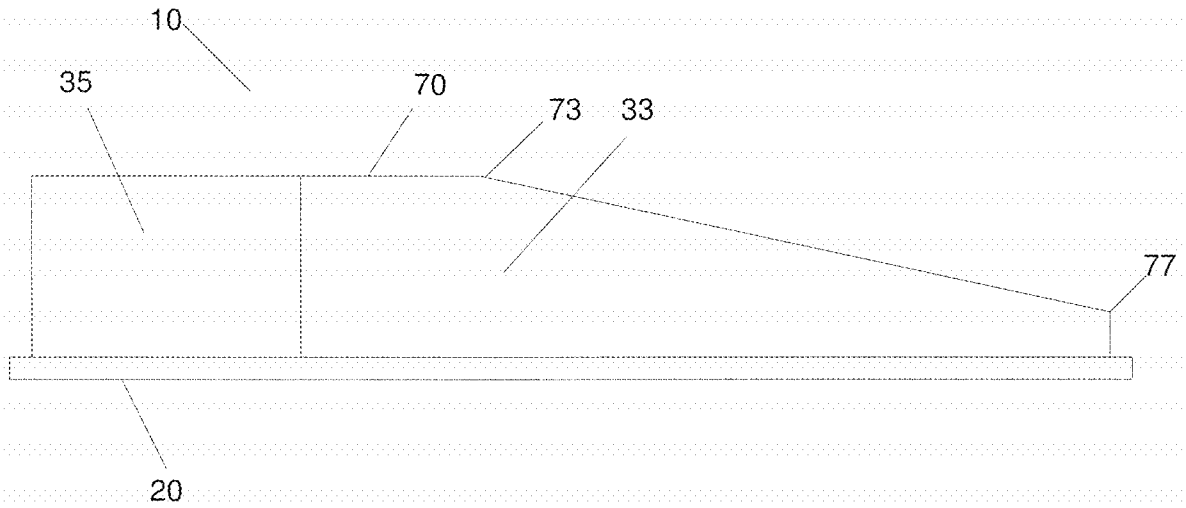
FIG. 2 shows a side view of the first exemplary pitching mound form.

FIG. 2 shows a side view of the first exemplary pitching mound form 10. The side view of the pitching mound form 10 shows the perimeter flange 20, one of the side rails 33, and the plateau portion 35. As shown in FIG. 2, the plateau portion 35 has a flat surface at a height that is proper for the mound. The side rail 33 has a variable height that starts as the same height as the plateau portion 35 in the area 70 and then tapers starting at location 73 at a desired slope until reaching location 77.

Figure 3:
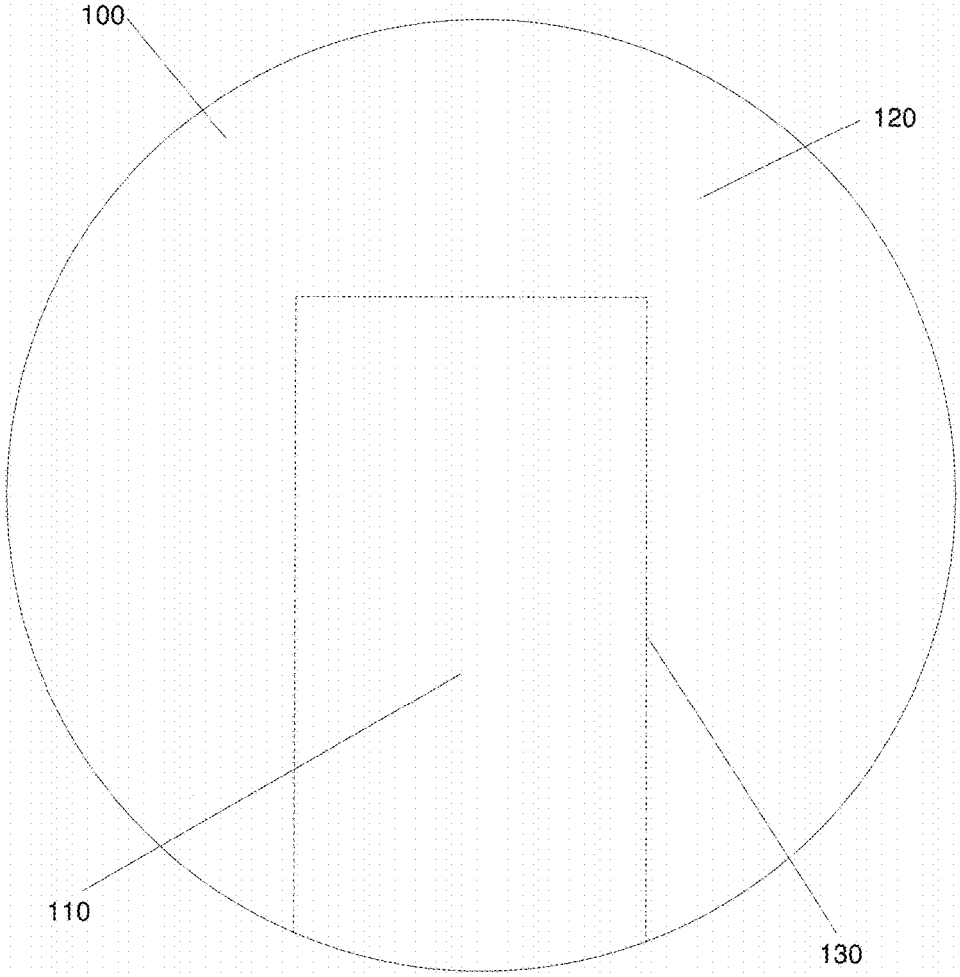
FIG. 3 shows an exemplary pitching mound having a cutout for the insertion of the first exemplary pitching mound form.

FIG. 3 shows an exemplary pitching mound 100 having a cutout 110 for the insertion of the first exemplary pitching mound form 10. Similar to the first exemplary pitching mound form 10, the pitching mound 100 is not provided with any dimensions as this may represent any pitching mound into which the pitching mound form 10 may be inserted.

In FIG. 3, the area 120 of the pitching mound 100 that is outside of the dashed lines 130 represents an ordinary pitching mound that may be constructed of any material, but is normally constructed of clay. The cutout 110 that is inside the dashed lines 130 is an open cavity into which the first exemplary pitching mound form 10 will be inserted. The base of the cutout 110 may be several inches below the surface of the playing field, level with the surface of the playing field or above the surface of the playing field. Thos skilled in the art will understand that the cutout 110 should be sized and spaced such that when the pitching mound form 10 is inserted into the cutout 110, the pitching mound form 10 is securely anchored to the ground so that no movement occurs during use. Thus, the most secure type of cutout 110 may be one where the base is below the surface of the playing field. However, it is noted that such a cutout is not required.

Figure 4:
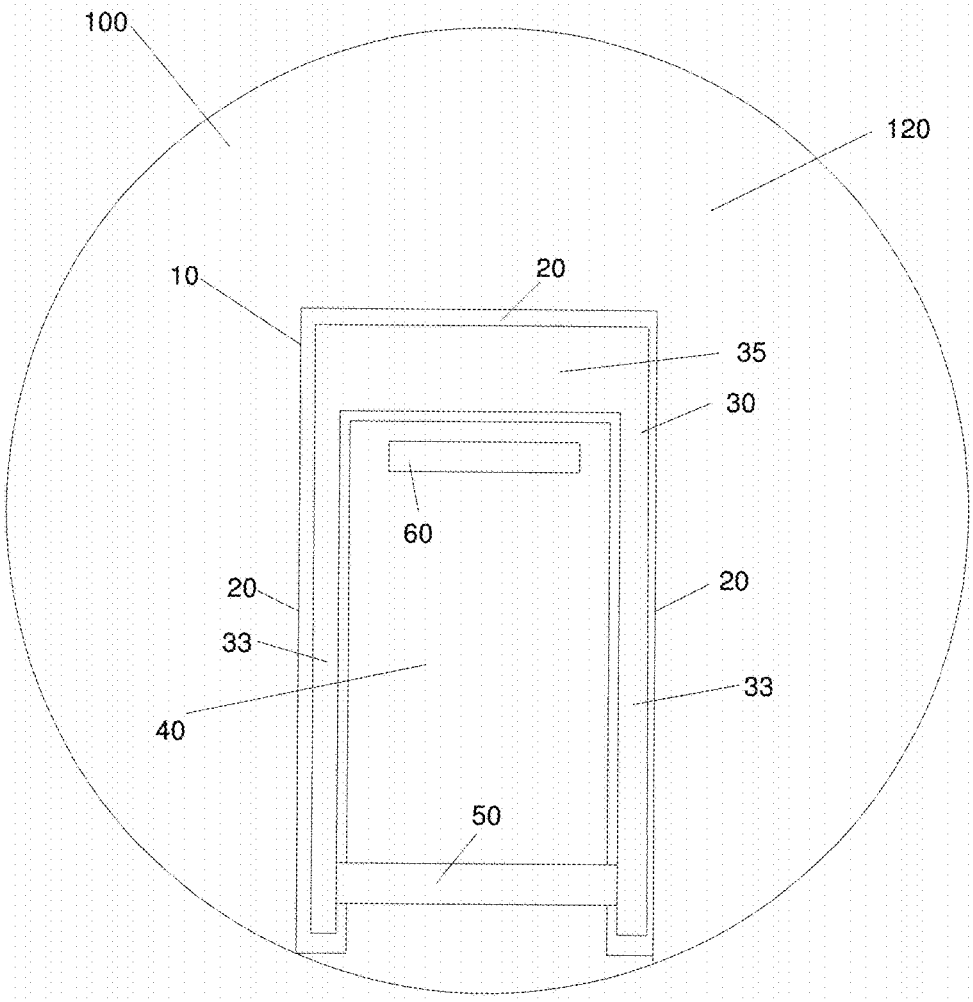
FIG. 4 shows the exemplary pitching mound having the first exemplary pitching mound form inserted into the cutout.

FIG. 4 shows the exemplary pitching mound 100 having the first exemplary pitching mound form 10 inserted into the cutout (not shown). In FIG. 4, the cutout 110 of FIG. 3 has been filled in with the pitching mound form 10. It should be noted that in FIG. 4, no additional material (e.g., pitching mound clay) has been added to the pitching mound form 10 at this point. Thus, all the components of the pitching mound form 10 remain visible, including the perimeter flange 20, the wall structure 30 having the side rails 33 and the plateau portion 35, the structural member 50 and the rubber 60. In this example, the eyelets 25 of the perimeter flange 20 are not shown for ease of illustration, but the perimeter flange 20 may have the eyelets 25 to secure the pitching mound form 10 to the ground as described above.

Thus, as shown in FIG. 3, the pitching mound 100 may be prepared having the cutout 110. In FIG. 4, the pitching mound form 10 may be placed into the cutout such that the bottom of the perimeter flange 20 is in contact with the base of the cutout, which, as described above, in one exemplary embodiment may be below the surface of the playing field. The pitching mound form 10 may then be secured to the ground using spikes or other fastening devices that may be inserted through the eyelets 25. At this point, the mound is not yet ready for play because the cavity 40 is still exposed. The cavity 40 needs to be filled with mound material such as clay or clay bricks. This will be described in greater detail below.

It should be noted that the above exemplary procedure for inserting the pitching mound form 10 into the pitching mound 100 may also be carried out in different manners. For example, instead of initially creating the pitching mound 100, the pitching mound form 10 may first be placed on the field and secured to the ground as described above without the pitching mound 100 being formed. That is, the pitching mound form may be placed in the correct location and orientation with respect to the remainder of the field, e.g., with the rubber being the correct distance to home plate, with the side rails being tapered toward home plate, with the pitching mound form being square with respect to the other bases, etc. After the pitching mound form 10 is placed in the correct location and orientation on the field, the pitching mound 100 may then be formed around the pitching mound form 10. As described above, the plateau portion 35 of the pitching mound form 10 is the correct height for the top of the mound and the side rails 33 have the correct slope for the front of the mound. Therefore, material such as clay or clay bricks may be used to form the pitching mound 100 using the dimensions of the pitching mound form 10.

Figure 5:
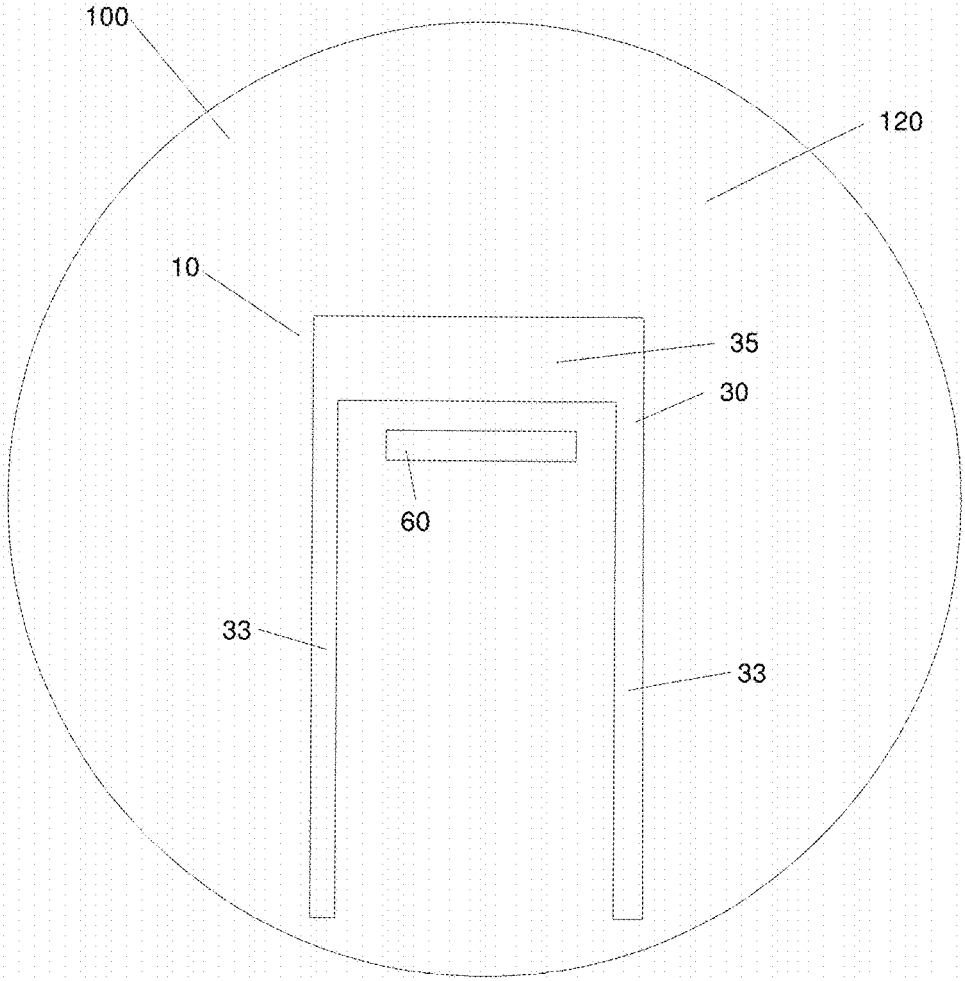
FIG. 5 shows the exemplary pitching mound having the first exemplary pitching mound form inserted into the cutout and fully formed for playing.

FIG. 5 shows the exemplary pitching mound 100 having the first exemplary pitching mound form 10 inserted into the cutout and fully formed for playing. As described above, after the pitching mound form 10 has been inserted into the cutout and secured to the ground, the cavity 40 may be filled with pitching mound material such as clay. Thus, the pitching mound material covers the perimeter flange 20 and the structural member 50. It should be noted that throughout the remainder of this description, the pitching mound material will be described as clay. However, those skilled in the art will understand that other material may be used to construct the mound. The only remaining portions of the pitching mound form 10 that are visible are the rubber 60 and the top surfaces of the plateau portion 35 and the side rails 33, which as described above may include a synthetic material that is applied on the top surfaces to prevent the pitcher from slipping when being stepped on. However, it should be noted that the distance between the side rails 33 should be such that the pitcher, when pitching, will not step on the side rails during a normal pitching motion.

As described above, the pitching mound form 10 has the correct height for the top of the pitching mound 100 at the plateau portion 35 and the correct slope for the front of the pitching mound based on the side rails 33. Thus, the people who maintain the field may fill the cavity 40 with clay to the top of the wall structure 30 such that by raking the clay to ensure that the top of the clay is even with the wall structure 30, the proper mound height and slope is achieved.

In such an arrangement, the people who maintain the pitching mound 100 do not need any special knowledge of the rules of the game, rather they just need to confirm that the cavity 40 is filled to the level as described above and the pitching mound 100 will conform to the rules because the pitching mound form 10 has the correct height and slope for the pitching mound 100. In addition, the correct dimensions for the pitching mound 100 also ensures that the pitchers are pitching from a consistent pitching mound and landing on a consistent location that will aid in preventing injuries.

Figure 6:
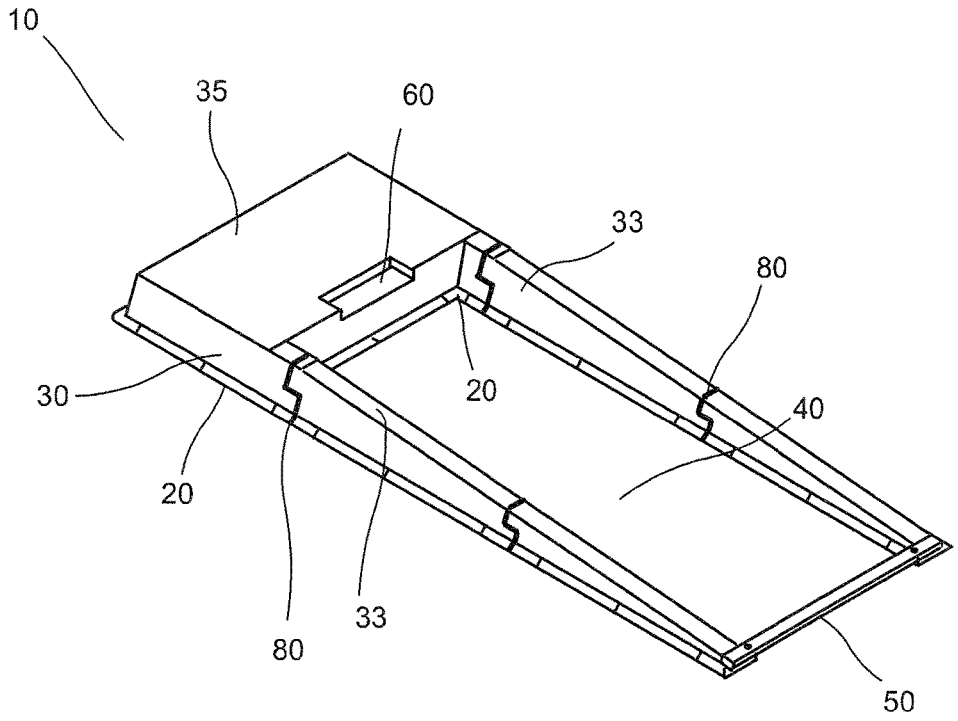
FIG. 6 shows a perspective view of the first exemplary pitching mound form.

FIG. 6 shows a perspective view of the first exemplary pitching mound form 10. This view shows the same general components as shown above, including the perimeter flange 20, the wall structure 30 having the side rails 33 and the plateau portion 35, the cavity 40, the structural member 50 and the rubber 60. This view shows some minor design differences from the above views of the first exemplary pitching mound form 10. For example, the structural member 50 is placed lower on the side rails 33. As described above, the structural member or members 50 may be placed in any location to provide structural support for the pitching mound form 10.

Also, in this exemplary embodiment, the rubber 60 is placed in the plateau portion 35. For example, the plateau portion 35 may have a cutout portion into which the rubber 60 may be placed such that the front of the rubber 35 is within or adjacent to the cavity 40. In this manner, when the cavity 40 is filled with clay, the pitcher when standing in the front of the rubber 60 (e.g., in the stretch position) will be standing in the clay. This arrangement also alleviates the need to separately attach the rubber 60 to the side rails 33 or other structural component of the pitching mound form 10.

It is also noted that the side rails 33 are shown as having joints 80. In this example, the side rails 33 and other components of the pitching mound form 10 may be formed from a plurality of parts that have been molded. These plurality of parts may then be joined to assemble the pitching mound form 10 at the location in which it is to be installed. In this manner, the pitching mound form 10 does not need to be shipped as a unitary structure, but may be shipped in a smaller box and assembled at the field where it is to be installed.

Figure 7:
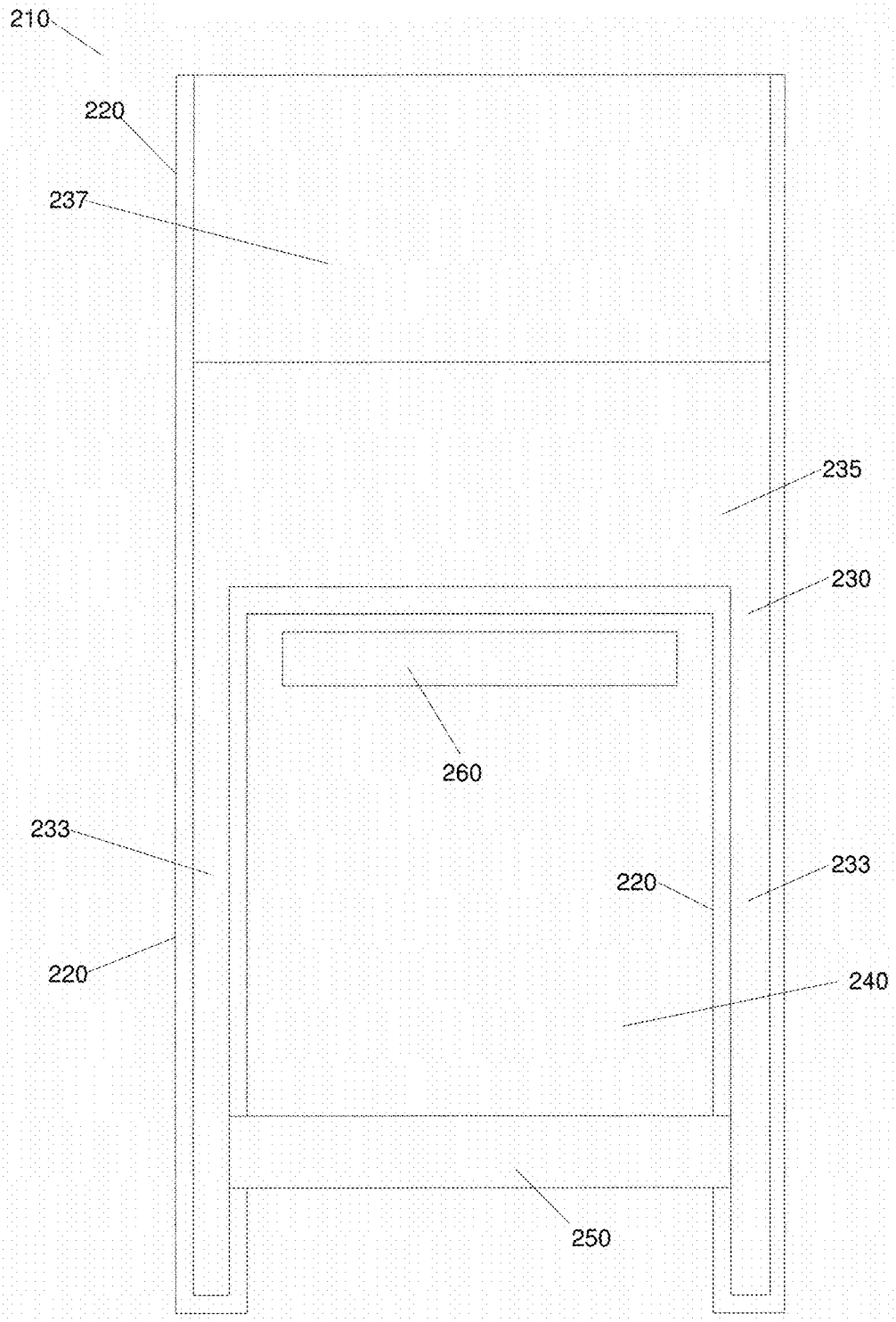
FIG. 7 shows a top view of a second exemplary pitching mound form that may be used on a 60/90 field.

The above described the generic first exemplary pitching mound form 10. The following will provide additional exemplary embodiments of the pitching mound form for use on specific types of fields. FIG. 7 shows a top view of a second exemplary pitching mound form 210 that may be used on a 60/90 field. The pitching mound form 210 includes the same general components as the first exemplary pitching mound form 10 described above, including a perimeter flange 220, a wall structure 230 having sidewalls 233 and a plateau portion 235, a cavity 240, a structural member 250 and a rubber 260. Again, the perimeter flange 220 may have the eyelets (not shown) for use in securing the pitching mound form 210 to the ground.

A difference between the second exemplary pitching mound form 210 and the first exemplary pitching mound form 10 is that the wall structure 230 also includes a back slope section 237. As will be described in greater detail below, the second exemplary pitching mound form 210 may extend from substantially the front of the pitching mound to substantially the back of the pitching mound. Therefore, the second exemplary pitching mound form 210 also has the back slope section 237. Unlike the side rails 233 that form the cavity 240, the back slope section 237 may have a top surface in the same manner as the plateau portion that covers any cavity in the back area of the second exemplary pitching mound form 210. This back slope section 237 allows for less maintenance because the back of the mound may have a synthetic covering in the same manner as the plateau portion 235 that does not require any maintenance, except for the occasional clearing of clay or other material that has gathered on the back slop section 237. The back slope section 237 tapers down from the plateau portion 235 to the level of the playing field. In one exemplary embodiment, teams may place a logo on the back slope section 237 that is visible from various locations within the field or stadium.

The plateau section 235 will have a height of 10 inches, which is the correct pitching mound height for the 60/90 field. It should be noted that the height of 10 inches is relative to the surface of the playing field. For example, the overall height of the pitching mound form 210 may be greater than 10 inches if the pitching mound form 210 is designed to rest on the ground that is lower than the playing field to provide a more stable surface for the pitching mound form. For example, the base of the cutout 110 shown in FIG. 3, may be lower than the surface of the playing field. The pitching mound form 210 would then have a height that accounts for this lower insertion point such that when the pitching mound form 210 is fully installed, the height of the plateau portion 235 is 10 inches above the playing surface.

Figure 8:
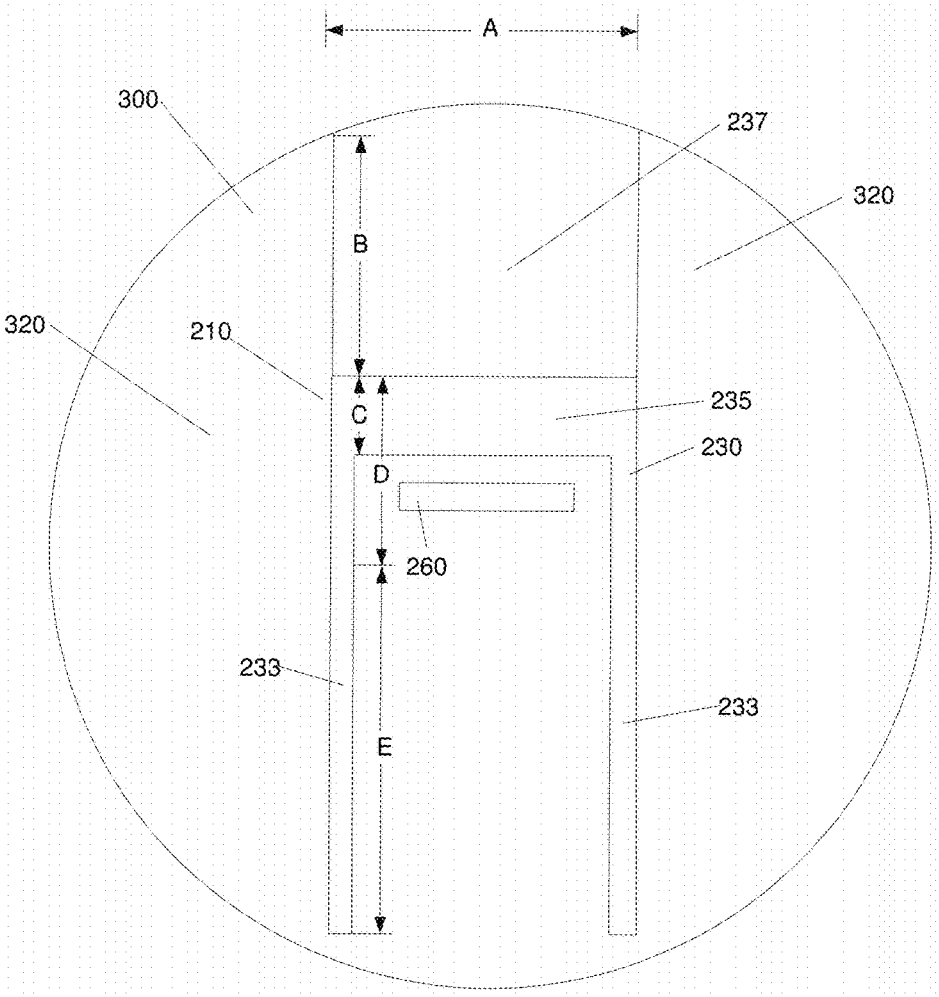
FIG. 8 shows an exemplary 60/90 pitching mound having the second exemplary pitching mound form inserted into the pitching mound and fully formed for playing.

FIG. 8 shows an exemplary 60/90 pitching mound 300 having the second exemplary pitching mound form 210 inserted into the pitching mound 300 and fully formed for playing. The visible sections of the pitching mound form are the top surfaces of the side rails 233, the plateau portion 235 and the back slope section 237. In addition, the rubber 260 is also visible. The insertion of the pitching mound form 210 into the cutout of the pitching mound 300 was not described as it is substantially the same as the insertion process described above for the pitching mound form 10. The difference being that the cutout in the pitching mound 300 essentially bisects the pitching mound 300 into two sections 320 because it extends from the front to the back of the pitching mound 300 to accommodate the pitching mound form 210.

For an exemplary 60/90 field, the pitching mound 300 and the pitching mound form 210 may have the following exemplary dimensions. The circumference of the pitching mound 300 is 56'6". The width of the pitching mound form 210 measured from the outside of the side rails 233, plateau portion 235 or back slope section 237 is 60" (dimension A in FIG. 8). The back slope section is 60"×60" (dimensions A and B in FIG. 8) and as described above, tapers from the plateau portion 235 to the back of the pitching mound 300. The plateau portion 235 has a flat surface and is 21"×60" (dimensions A and C in FIG. 8). The flat portion at the top of the pitching mound which includes the plateau portion 235 and the portion of the side rails 233 before the side rails starts tapering is 36" (dimension D in FIG. 8). The rubber 260 is located in this flat portion and the rubber has a dimension of 6"×24". The side rails 233 taper for a distance of 108" (dimension E in FIG. 8) and taper at a rate of 1 inch per foot. It will be noted that this slope will result in a further 1 inch of slope being needed to bring the pitching mound 300 to the same height as the field. This may be accounted for by the pitching mound form 210 being 1 foot shorter than the distance from the front to the back of the pitching mound 300. In another exemplary embodiment, the dimension E may be the full 120" needed to taper the pitching mound to field level. Again, it is noted that the distances and dimensions provided are only exemplary and other distances and dimensions may be used.

Figure 9:
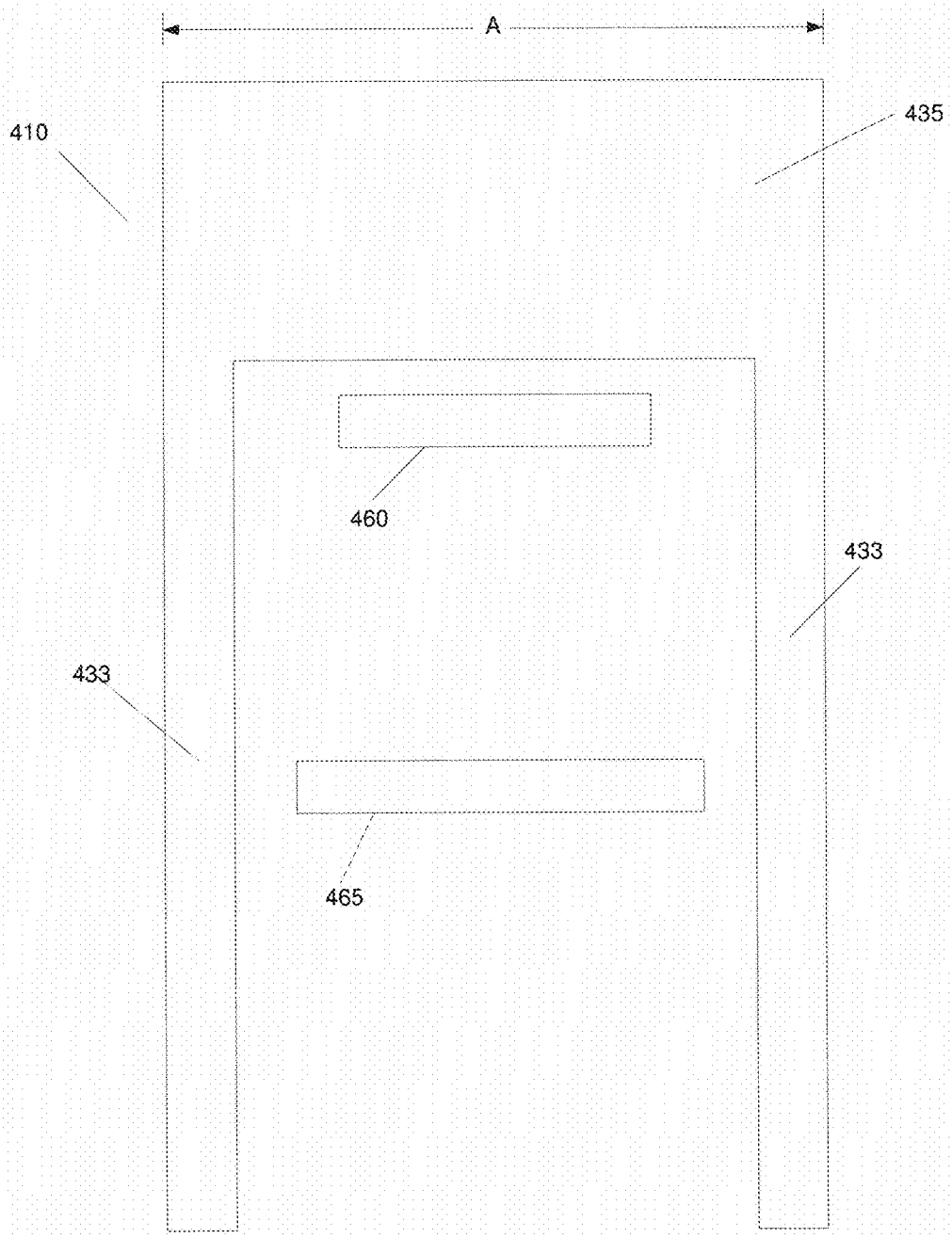
FIG. 9 shows a top view of a third exemplary pitching mound form for a conversion mound.

FIG. 9 shows a top view of a third exemplary pitching mound form 410 for a conversion mound. The conversion mound is a mound that may be used for multiple sized fields. In this example, the conversion mound may be used for a 50/70 field and a 46/60 field. As described above, a 50/70 field has the pitching rubber 50 feet from home plate, while the 46/60 field has the pitching rubber 46 feet from home plate. The pitching mound form 410 accommodates both distances without having to alter the pitching mound. It should be noted that FIG. 9 shows the pitching mound form 410 when it has been inserted into the pitching mound (not shown), where only the top surfaces of the plateau portion 435, the side rails 433 and the rubbers 460 and 465 are shown. It should be understood that the pitching mound form 410 may also include the structural member(s) and the perimeter flange as in the other exemplary embodiments. In addition, the pitching mound form 410 is not shown to include the sloped back section as in the pitching mound form 210. However, it should be understood that the pitching mound form 410 may also include a sloped back section in the same manner as the pitching mound form 210.

Since the pitching mound form 410 is for a smaller field (e.g., 46/60 or 50/70) that has a smaller pitching mound, the pitching mound form 10 may have smaller dimensions than the pitching mound form 210. For example, the width may be 48 inches (shown as dimension A in FIG. 9). The plateau may have a dimension of 30"×48" and a flat top surface that is 8.5" above the surface of the playing field. The rubber 460 may have a dimension of 4"×18", which is the dimension for a 50/70 field. The back of the rubber 460 may be located 2" from the edge of the plateau portion 435. The flat portion of the side rails 433 may extend for 6" in front of the rubber 460. The side rails 433 may then slope at a rate of ¾" per foot. Again, as has been noted above, the dimensions provided herein are only exemplary and other dimensions for the pitching mound form may be used.

Besides the dimensions, the pitching mound form 410 differs from the pitching mound form 210 in that a removable second rubber 465 is included in the pitching mound form 410. In FIG. 9, the second rubber 465 is shown as being inserted, but it may also be removed. For example, when the field is configured for a 46/60 game, the second rubber 465 may be inserted and used by the pitcher. However, when the field is configured for a 50/70 game, the second rubber 465 may be removed and the rubber 460 may be used by the pitcher. Thus, the pitcher in the 50/70 game does not need to worry about stepping on the second rubber 465. In addition, the field and pitching mound may be easily converted between the two different sized fields. It should be noted that the rubber 460 may also be configured to be a removable rubber.

Figure 10:
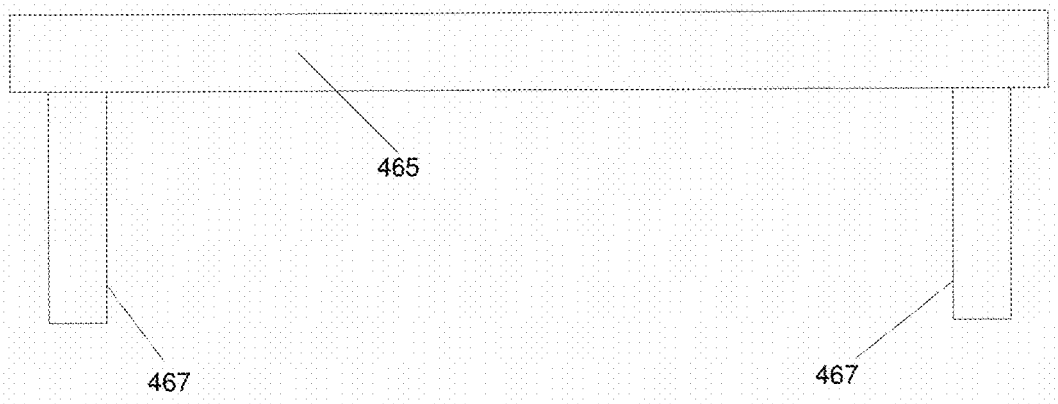
FIG. 10 shows a front view of an exemplary arrangement for a removable second rubber.

The second rubber 465 is designed to have the same dimensions as the rubber 460, e.g., 4"×18". However, the second rubber 465 may be extended to 4"×26" to allow 4 inches on either side for removable attachment to the pitching mound form 410. The extra 4 inches on each side may be blacked out so the pitcher knows not to stand on these sections. FIG. 10 shows a front view of an exemplary arrangement for the removable second rubber 465. In the extra 4 inches on the side of the second rubber 465, pegs 467 extend from the bottom of the rubber 465. The pegs 467 are designed to fit into corresponding holes (or cavities) that are included in the pitching mound form 410. For example, a hollow pipe may extend up from the perimeter flange (or other component) into which the pegs 467 may be inserted to anchor the second rubber 465 when in use. It should be noted that the pegs 467 do not need to be any particular shape, but may be round, square, etc. The corresponding pipe or cavity should have the same generally shape as the pegs 467 for a snug fit.

Figure 11:
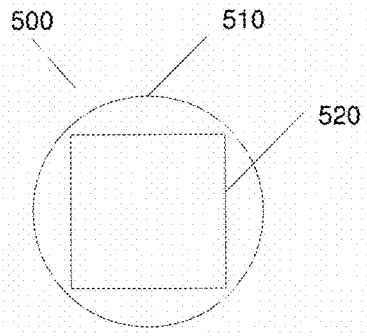
FIG. 11 shows an exemplary cavity that may be formed in the pitching mound form to accept the pegs of the removable rubber.
Figure 12:
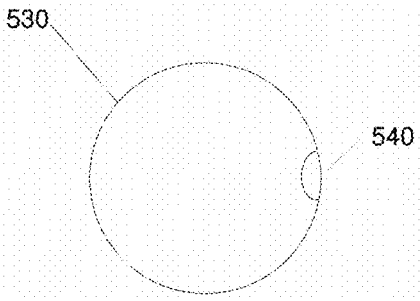
FIG. 12 shows an exemplary plug that may be placed into the outer circular portion to cover the cavity when the removable rubber is removed.

FIG. 11 shows an exemplary cavity 500 that may be formed in the pitching mound form 410 to accept the pegs 467 of the removable rubber 465. The cavity includes an outer circular portion 510 and an inner square portion 520. The pegs 467 may have a corresponding square shape and fit into the square portion 520 to anchor the rubber 465. The inner square portion 520 may be within and slightly lower than the outer circular portion 510. FIG. 12 shows an exemplary plug 530 that may be placed into the outer circular portion to cover the cavity when the rubber 465 is removed. The plug 530 should be flush with the surface of the mound so it does not interfere with the pitcher using the rubber 460. The plug 530 may also have a thumbhole 540 or other mechanism to remove the plug 530 from the cavity. The cavity may be referred to as a receiving portion of the pitching mound form 410 because it is configured to receive the pegs 467 and the plugs 530.

Figure 13:
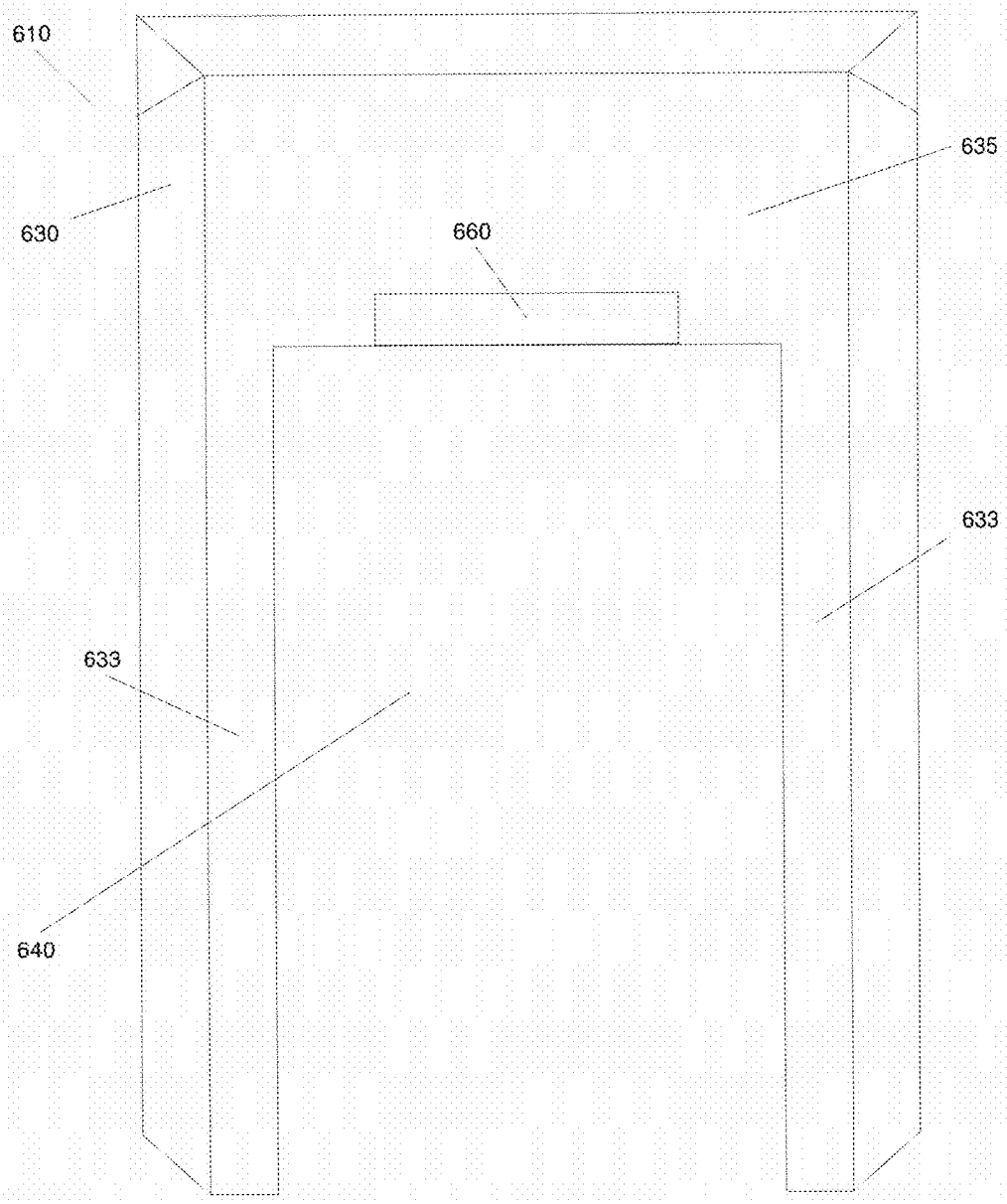
FIG. 13 shows a top view of a fourth exemplary pitching mound form that may be used for a bullpen or home mound.

FIG. 13 shows a top view of a fourth exemplary pitching mound form 610 that may be used for a bullpen or home mound. The pitching mound form 610 may be used for any dimension field. In the bullpen or on a home pitching mound, the entire pitching mound may not be needed. Thus, the wall structure 630 may slope down from the side rails 633. The cavity 640 may be filled with clay and the rubber 660 may be an integral part of the plateau section 635 as in the embodiment described above. Thus, in the bullpen or at home, once the cavity 640 is filled with clay, the pitcher may practice pitching on a proper mound (e.g., height and slope) without having to build the entire pitching mound.

Figure 14:
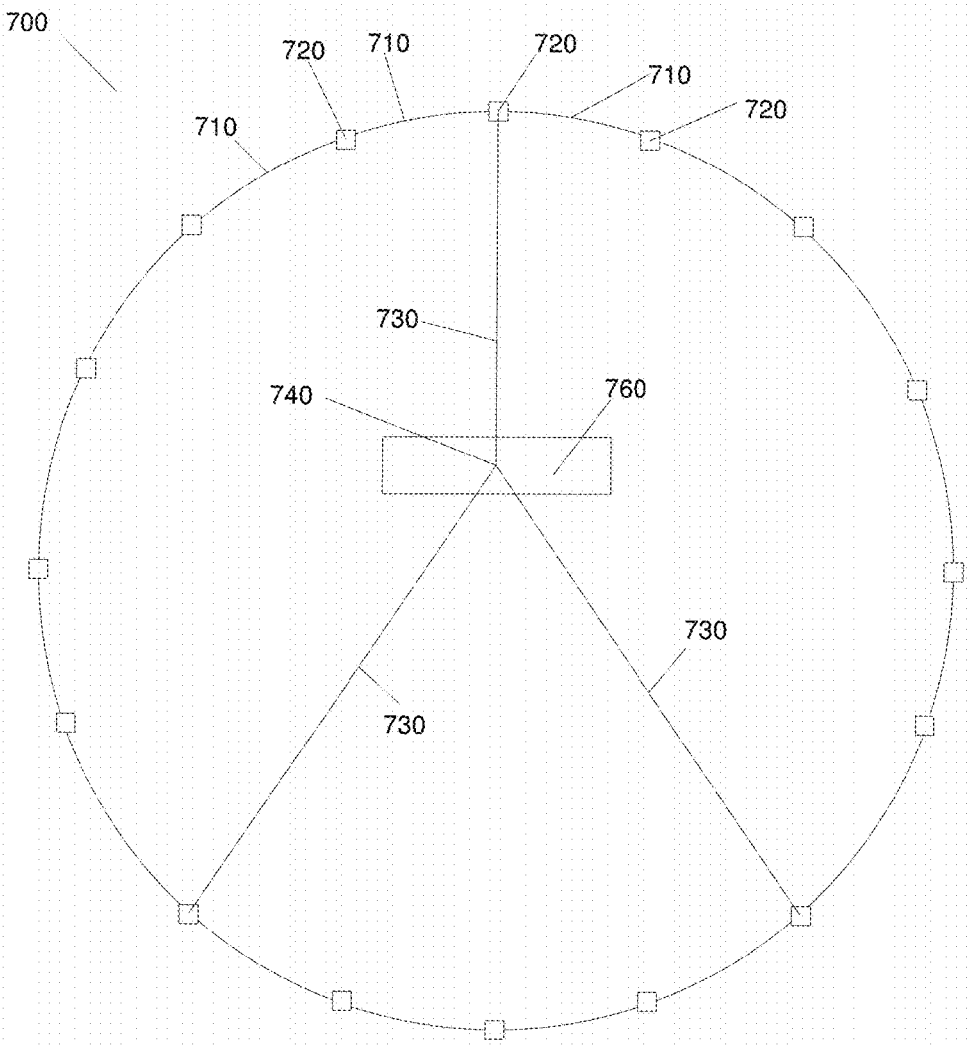
FIG. 14 shows an exemplary arrangement that is used to build a pitching mound.

FIG. 14 shows an exemplary arrangement 700 that is used to build a pitching mound. As described above, one manner of building a pitching mound may be to place one of the exemplary embodiments of the pitching mound forms at the correct location and orientation with respect to the field, e.g., the rubber being the correct distance from home plate. In FIG. 14, it may be considered that the rubber 760 is the rubber from one of the exemplary embodiments of the pitching mound forms, but the remainder of the pitching mound form is not being shown for ease of illustration. It may also be considered that the rubber 760 is accurately placed on the field.

FIG. 14 also shows an arrangement 700 that may then be used to build a mound around the pitching mound form. The arrangement 700 includes a series of segments 710 that are connected by a series of connectors 720. The segments 710 may fit into the connectors 720 in any known manner to connect the segments 710. The segments 710 may be connected to form a circle having the correct circumference for the pitching mound for the desired field size. The segments 710 may also be disconnected for easy storage. The segments 710 may be constructed of any material such as plastic, metal, a composite, etc.

The arrangement 700 also includes at least three radial segments 730, but other numbers of radial segments 730 may also be used, e.g. 5. In this exemplary embodiment, the radial segments 730 extend from a corresponding one of the connectors 720, but they may also extend from one of the segments 710. The radial segments meet at a common point 740. When the arrangement 700 is fully constructed (e.g., the segments 710 form the circle and the radial segments 730 are connected), this common point 740 may be placed on a predefined location on the rubber 760. When this occurs, the circle that is formed from the segments 710 show the correct location of the circumference of the pitching mound. This circle may then be used to build the pitching mound around the pitching mound form. The radial segments 730 may be constructed of any material such as string, nylon line, etc.

It will be apparent to those skilled in the art that various modifications may be made in the present invention, without departing from the spirit or scope of the invention. Thus, it is intended that the present invention cover the modifications and variations of this invention provided they come within the scope of the appended claims and their equivalents.

What is claimed is:

1. A pitching mound form, comprising:

a flange structure comprising a bottom and a top, wherein, in an operable position, the bottom is configured to rest on a support surface; and a wall structure comprising a first side rail and a second side rail and a plateau portion, each of the first side rail and the second side rail is coupled to the flange structure and extend upwardly substantially perpendicular from the top of the flange structure, wherein the first side rail and the second side rail and the plateau portion form a substantially rectangular cavity therebetween, the plateau portion forming a first end of the rectangular cavity and a second end of the rectangular cavity being opposite the first end, wherein the support surface is accessible via the cavity, wherein the first side rail and the second side rail have a first height at the first end of the rectangular cavity and a second height at the second end of the rectangular cavity, and wherein the first side rail and the second side rail have the first height for a predetermined length extending from the first end in a direction toward the second end and then taper at a predetermined slope to the second end.

2. The pitching mound form of claim 1, wherein the flange structure has a plurality of eyelets.

3. The pitching mound form of claim 1, further comprising a structural member configured to keep the cavity substantially rectangular.

4. The pitching mound form of claim 1, wherein the predetermined slope is one of 1 inch per foot or 14 inch per foot.

5. The pitching mound form of claim 1, further comprising:

a first pitching rubber located in the cavity between the first side rail and the second side rail at the first height.

6. The pitching mound form of claim 5, further comprising:

a second pitching rubber located in the cavity between the first side rail and the second side rail at the predetermined slope, wherein the second pitching rubber is removable.

7. The pitching mound form of claim 1, wherein the wall structure further comprises a sloped back section.

8. The pitching mound form of claim 5, wherein the pitching rubber is permanently coupled to the pitching mound form.

9. The pitching mound form of claim 5, wherein the pitching rubber is removably coupled to the pitching mound form.

10. The pitching mound form of claim 5, wherein the pitching rubber is attached to the wall structure.

11. The pitching mound form of claim 1, wherein the flange structure forms a "U" shape.

12. The pitching mound form of claim 1, wherein the wall structure comprises at least one joint between the first height and the second height.

* * * * *